US007387536B2

(12) United States Patent
Wang

(10) Patent No.: US 7,387,536 B2
(45) Date of Patent: Jun. 17, 2008

(54) ELECTRONIC PART-MOUNTING SOCKET

(75) Inventor: Long-Fei Wang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/728,754

(22) Filed: Mar. 27, 2007

(65) Prior Publication Data

US 2007/0232145 A1 Oct. 4, 2007

(30) Foreign Application Priority Data

Mar. 30, 2006 (CN) ..... 2006 2 0072003 U

(51) Int. Cl.
*H01R 9/03* (2006.01)

(52) U.S. Cl. ..... 439/610; 439/607

(58) Field of Classification Search ..... 439/607, 439/610

See application file for complete search history.

(56) References Cited

U.S. PATENT DOCUMENTS 5,288,248 A * 2/1994 Chen ..... 439/609
6,986,681 B2 * 1/2006 Tsai ..... 439/607
7,077,664 B1 * 7/2006 Wang et al. ..... 439/70
2002/0187680 A1 * 12/2002 Lee ..... 439/610
2005/0153600 A1 * 7/2005 Lu ..... 439/607
2005/0215117 A1 * 9/2005 Asai et al. ..... 439/607

* cited by examiner

*Primary Examiner*—Tho D. Ta
*Assistant Examiner*—Travis Chambers
(74) *Attorney, Agent, or Firm*—Wei Te Chung

(57) ABSTRACT

An electronic part-mounting socket (100) includes a shielding housing (3) defining a receiving cavity (34) for receiving an electronic part. Each of opposed side wall sections (31) of the shielding housing defines a hinge edge (314) with opposed sides. Each side wall section has a portion bent as a resilient contact tongue (315), which is joined to one side of the hinge edge and has a free end thereof inwardly projecting into said receiving cavity for resiliently retaining the electronic part. An extension piece (316) is integrally joined to the other side of the hinge edge and constructed to allow the resilient contact tongue to flex about the hinge edge. Thus, as compared with the prior art, the resilient contact tongue will have a better resilient capability due to the additional extension piece, even after the repeated application of the socket.

10 Claims, 4 Drawing Sheets

ELECTRONIC PART-MOUNTING SOCKET

BACKGROUND OF THE INVENTION

1. Field of the Invention

The present invention relates to a socket for mounting an electronic part, mainly such as a camera module, on a printed wiring board such as an FPC.

2. Description of the Related Art

Many electronic devices including mobile telephones are increasingly diversified in function, and many models with built-in cameras are now available in the market. A socket for mounting an electronic part typically includes a shielding housing having a receiving cavity for receiving the electronic part therein, and a plurality of contacts held by a contact holding member to be disposed within the shielding housing for electrically mating with the electronic part. The shielding housing further defines a base section surrounded by a peripheral wall to form such a receiving cavity. Opposed rigid side wall sections of the peripheral wall are typically provided with resilient contact tongues for resiliently retaining the electronic part, which is to be received within the receiving cavity of the shielding housing.

A problem with the electronic part-mounting socket is that the electronic part is not securely retained by the pair of resilient contact tongues after repeated application of the electronic part-mounting socket. This is so because each resilient contact tongue is integrally joined to a rigid edge of the side wall section, and thus has no sufficient resilient capability after the repeated application of the electronic part-mounting socket. It is desirable that the resilient contact tongue be required to have a better resilient capability, even after the repeated application of the electronic-part mounting socket. Therefore, there is a need to provide a new electronic-part mounting socket to resolve the above-mentioned shortcoming.

SUMMARY OF THE INVENTION

An electronic part-mounting socket according to an embodiment of the present invention includes a shielding housing defining a base section surrounded by a peripheral wall so as to form a receiving cavity therebetween for receiving an electronic part. The peripheral wall includes a first pair of opposed side wall sections, with each side wall section defining a hinge edge with opposed sides. The side wall section has a portion bent as a resilient contact tongue, the resilient contact tongue integrally joined to one side of said hinge edge and having a free end thereof inwardly projecting into said receiving cavity for resiliently retaining the electronic part. An extension piece is integrally joined to the other side of said hinge edge and locatable outwardly of said receiving cavity. The arrangement of the extension piece allows the resilient contact tongue to flex about the hinge edge of each of the first pair of the side wall sections. Thus, as compared with the prior art, the resilient contact tongue will have a better resilient capability due to the additional extension piece, even after the repeated application of the electronic part-mounting socket.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
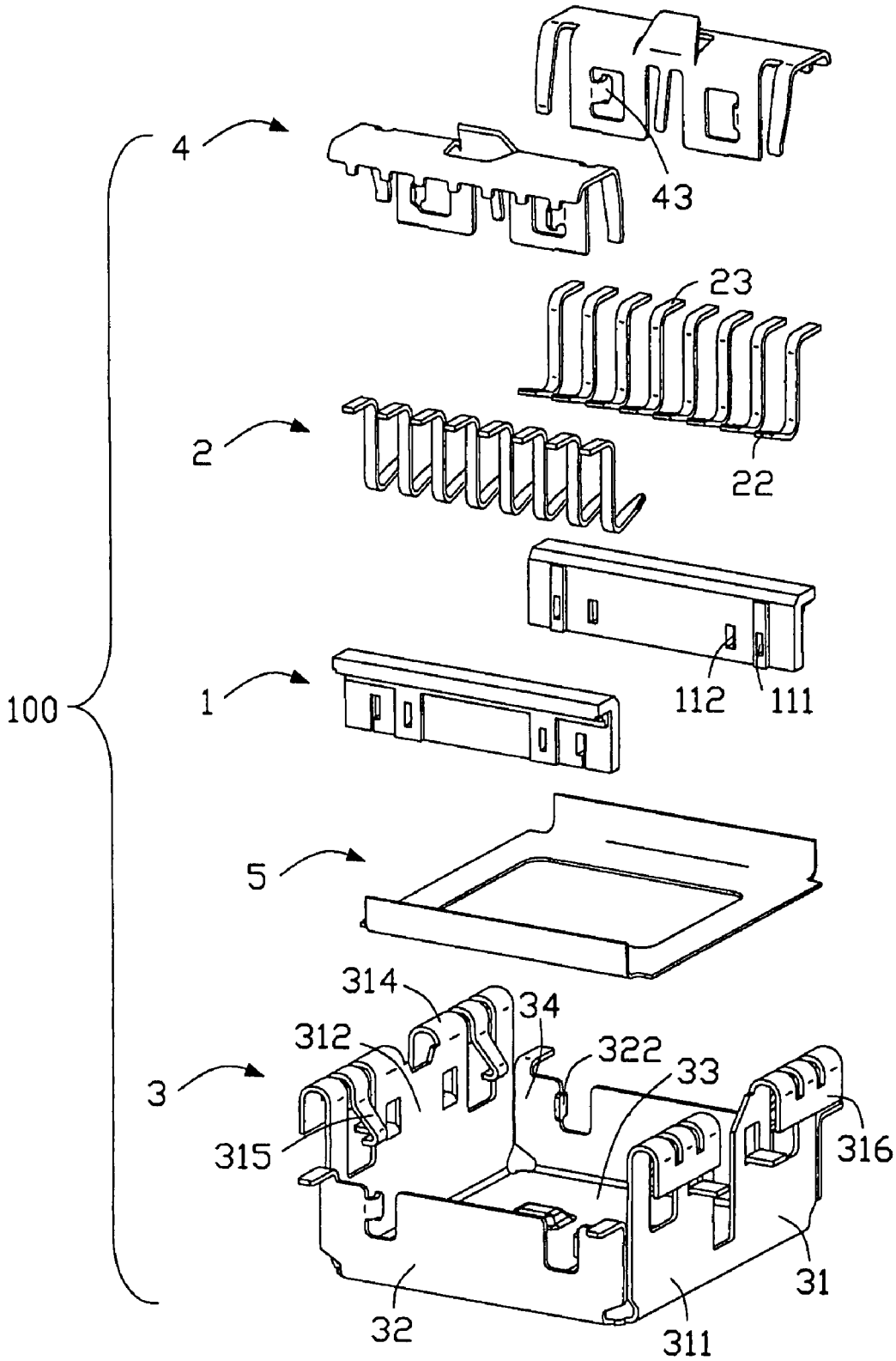
FIG. 1 is an exploded, perspective view of an electronic part-mounting socket according to an embodiment of the present invention.

Referring to FIGS. 1 to 4, an electronic part-mounting socket 100 according to an embodiment of the present invention is shown for mounting onto a printed circuit board (not shown). The electronic part-mounting socket 100 comprises a shielding housing 3 defining a receiving cavity 34 for receiving an electronic part (not shown), a plurality of contacts 2 held by a pair of contact holding members 1 to be received in the shielding housing 3, an insulative plate 5 disposed between bottom mating portions 22 of the contacts 2 and a bottom base section 33 of the shielding housing 3, and a pair of L-shaped shielding pieces 4 disposed outside of portions of the contacts 2 except for the bottom mating portions 22 of the contacts 2.

The shielding housing 3 includes the base section 33 surrounded by a peripheral wall so as to form such a receiving cavity 34 for receiving the electronic part. The peripheral wall of the shielding housing 3 further includes a first pair of opposed rigid side wall sections 31 and a second pair of opposed rigid side wall sections 32. Each of the second pair of opposed rigid side wall sections 32 is provided with locating latches 322 aligned with locating holes 111 of the contact holding member 1. Each of the first pair of opposed rigid side wall section 32, including a front side wall section 312 and a rear side wall section 311 thereof, is formed with at least one resilient contact tongue 315 for resiliently retaining the electronic part. More specifically, the front side wall section 312 defines a hinge edge 314 with opposed sides, and has a portion thereof bent as a resilient contact tongue 315 integrally joined to one side of the hinge edge 314. Each resilient contact tongue 315 includes a free end thereof inwardly projecting into the receiving cavity 34 for resiliently retaining the electronic part. Further, an extension piece 316 is integrally joined to the other side of the hinge edge 314 of the front side wall section 312, and locatable outwardly of the receiving cavity 34. The arrangement of the extension piece 316 allows the resilient contact tongue 315 to flex about the hinge edge 314 of each of the first pair of the side wall sections 31. Thus, as compared with the prior art, the resilient contact tongue 315 will have a better resilient capability due to the additional extension piece 316, even after the repeated application of the electronic part-mounting socket 100.

A plurality of contacts 2, arranged in a row and spaced in a predetermined distance, is disposed along a respective one of the second pair of opposed rigid side wall sections 32, with the mating portions 22 extending slightly upwardly from the bottom base section 33 of the shielding housing 3 for electrically mating with corresponding conductive elements (not shown) of the electronic part, and mounting portions 23 substantially perpendicular to the mating portions 22 and extending outwardly of a corresponding one of the second pair of side wall sections 32 for solderably mounting the electronic part-mounting socket 100 onto the printed circuit board. These contacts 2 are held in position by a pair of contact holding members 1, each made of an insulative material. Each of the contact holding members 1 is provided with the locating holes 111 aligned with the locating latches 322 of the shielding housing 3, and positioning slots 112 aligned with positioning catches 43 of the L-shaped shielding piece 4.

Figure 2:
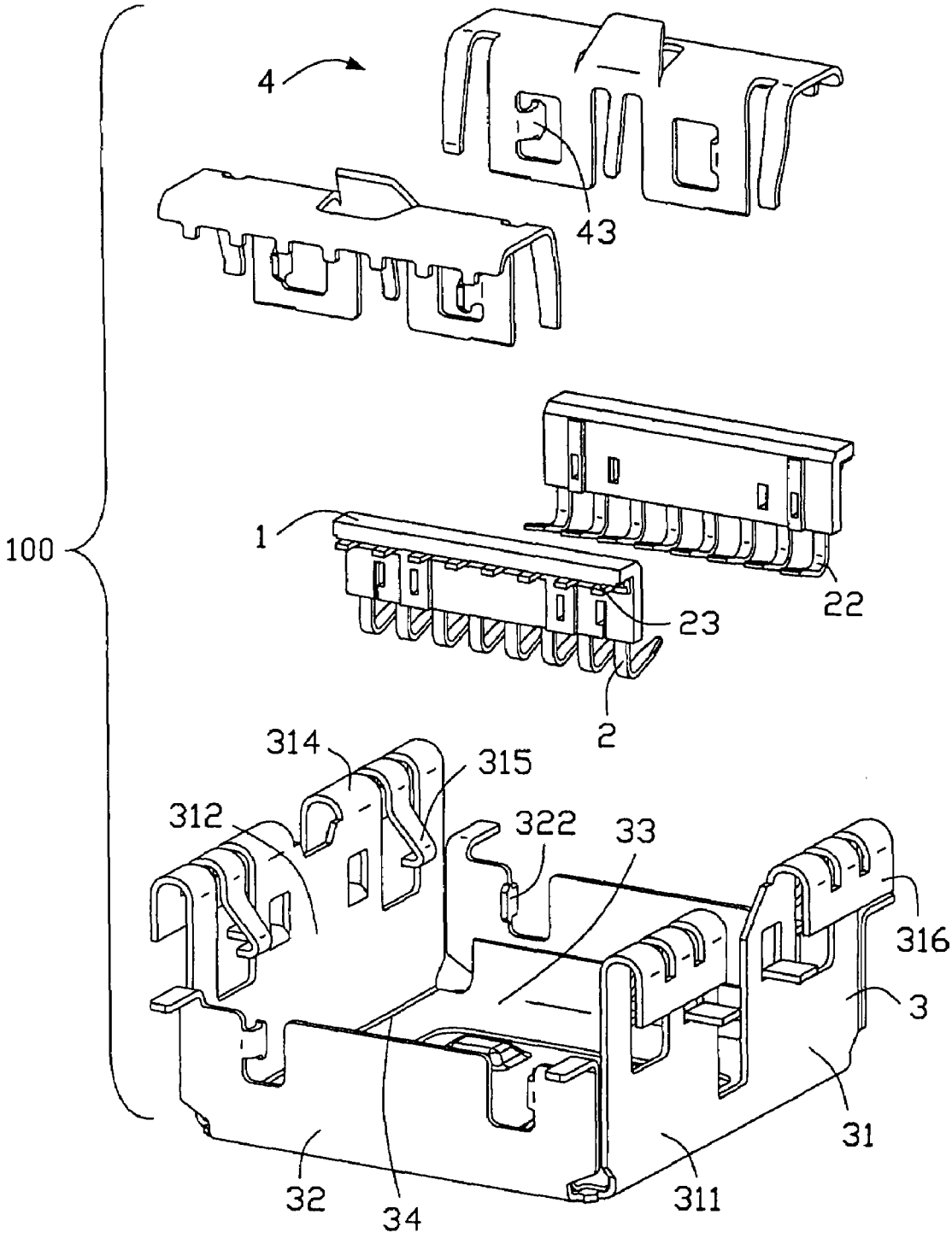
FIG. 2 is a partly-exploded, perspective view of the electronic part-mounting socket of FIG. 1.
Figure 3:
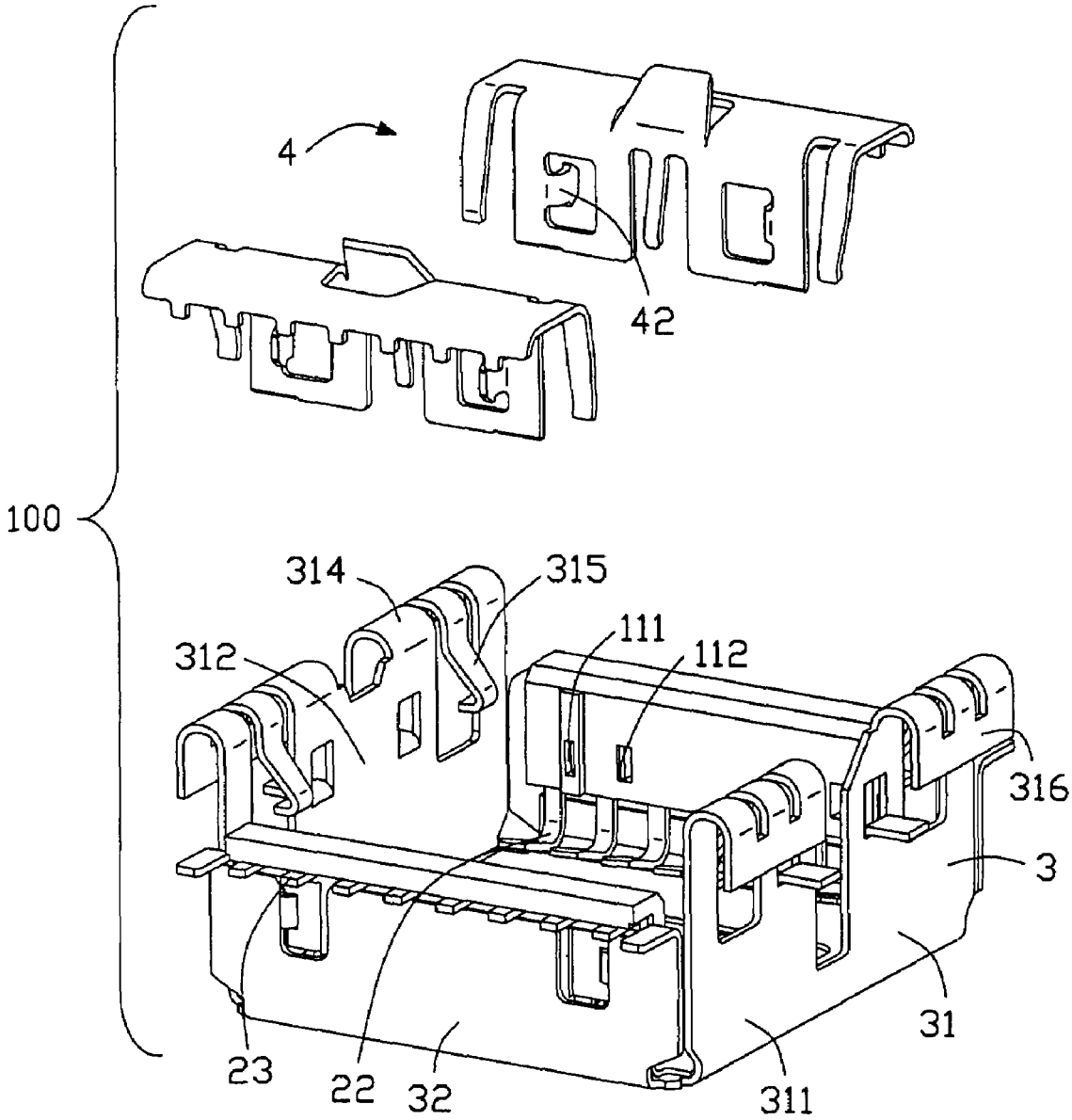
FIG. 3 is another partly-exploded, perspective view of the electronic part-mounting socket of FIG. 1.
Figure 4:
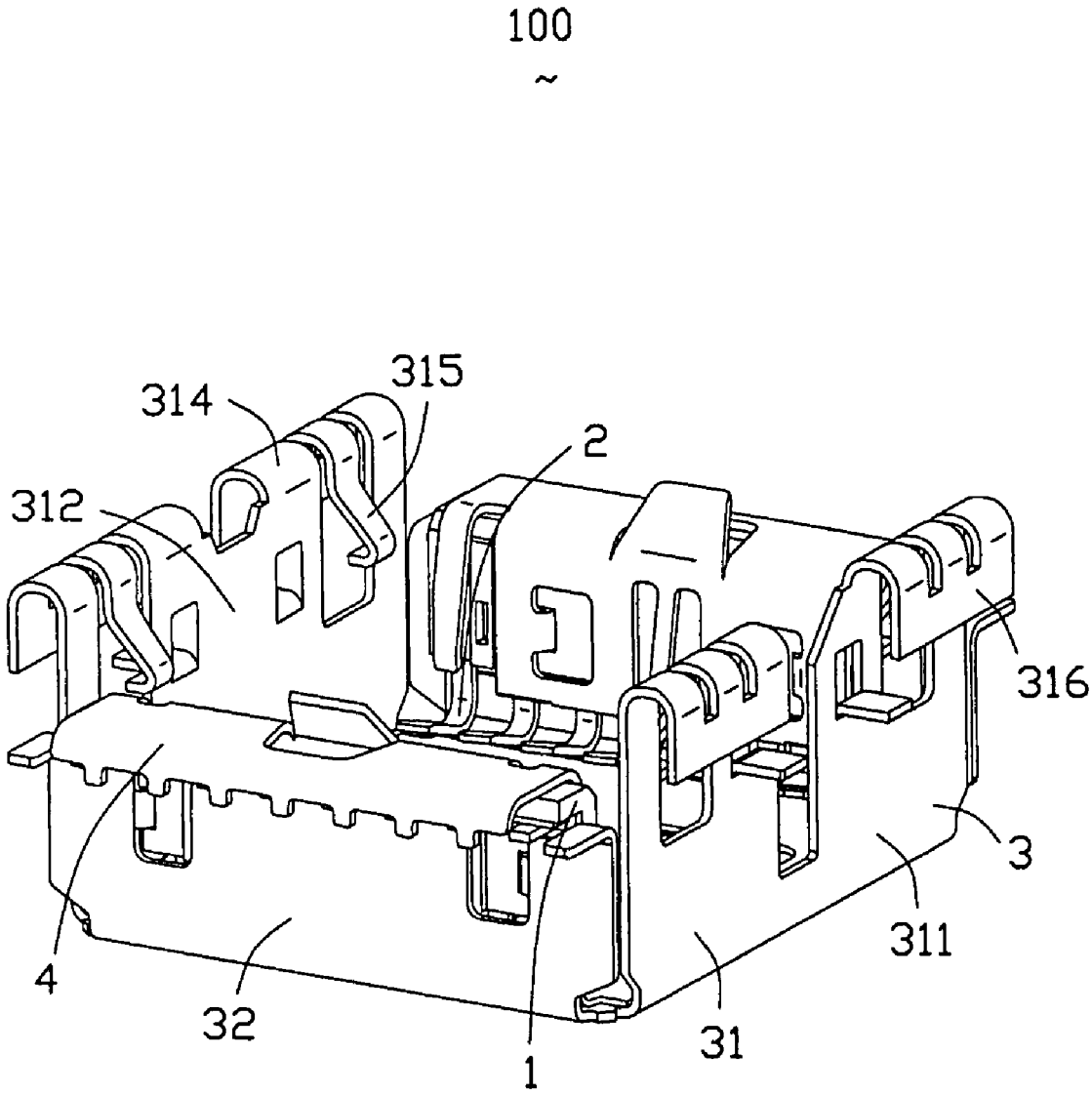
FIG. 4 is an assembled, perspective view of the electronic part-mounting socket of FIG. 1.

Referring to FIGS. 2 to 4, in assembly, the contacts 2 are pre-held by the pair of contact holding members 1 to be received within the shielding housing 3 in a manner to be disposed along the corresponding one of the second pair of side wall sections 32, with the insulative plate 5 disposed between the bottom mating portions 22 of the contacts 2 and the bottom base section 33 of the shielding housing 3 for preventing the formation of a short circuit between the contacts 2 and the shielding housing 3. The contact holding members 1 with the contacts 2 held thereon are assembled onto the second pair of side wall sections 32 by the locating latches 322 extending into the locating holes 111 of the contact holding members 1. The pair of L-shaped shielding pieces 4 are disposed outside of the portions of the contacts 2 except for the bottom mating portions 22 of the contacts 2 for effectively reducing the electromagnetic interference (EMI) induced by the contacts 2 so as to stabilize the transmission of electronic signal of the electronic part. The shielding pieces 4 are attached to the contact holding members 1 by the positioning catches 43 extending into the positioning slots 112 of the contact holding members 1.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector having metal shell, comprising:

a metal shell having a base defining an opening therein;

a first pair of peripheral walls extending upward from opposite pair of edges of the base, and a second pair of peripheral walls extending from the other pair of edges, wherein the first peripheral wall is higher than the second peripheral wall, the first and second pair of peripheral walls and the base jointly defining a receiving space therein;

first and second contact terminal insert securely attached to the second pair of peripheral walls, and having contact engaging portion extending into receiving space and directed toward each other;

each of the first peripheral walls having a flange portion extending outward and downward from top of the peripheral walls, and each of the flange portion of the first peripheral wall including a spring arm extending from the flange portion into the receiving portion, each of the spring arm including a stopper substantially parallel to the base portion; and a pair of clips each securely attaching the contact terminal insert to the second pair of peripheral walls, respectively.

2. The electrical connector as recited in claim 1, wherein the contact terminal insert includes a horizontal portion extending over an edge of the second pair of peripheral wall with mounting portion arranged thereof.

3. The electrical connector as recited in claim 2, wherein the clip includes a horizontal portion shielding the horizontal portion of the contact terminal insert.

4. An electrical connector comprising a metal shell having a bottom with peripheral walls jointly defining a receiving space therein, the peripheral walls including four side walls oppositely arranged and extending upward from the bottom;

at least an L-shaped contact terminal insert having short and long section attached to the first peripheral walls with a short section extending over the first peripheral wall; and at least a clip securely attaching the L-shaped contact terminal insert to the first peripheral wall, and including a horizontal portion substantially shielding the short section of the L-shaped contact terminal insert.

5. The connector as claimed in claim 4, wherein said opposite two of said side walls define horizontally extending legs at upper edges thereof coplanar with upper horizontal section.

6. The connector as claimed in claim 4, wherein the other two opposite of said side walls define a plurality of horizontally extending tags for engagement with the printed circuit board.

7. The connector as claimed in claim 4, wherein said shielding pieces define a plurality of downwardly extending tags for engagement with the printed circuit hoard.

8. The connector as claimed in claim 4, wherein the other two opposite of said side walls form resilient contact tongues for retaining the electronic component in the receiving space.

9. The connector as claimed in claim 8, wherein an upper face of the shielding piece is essentially coplanar with a downward engagement face of the resilient contact tongue which is adapted to engage the printed circuit board.

10. An electrical connector comprising:

a metallic shell defining four side walls and a bottom wall commonly defining a receiving space;

a pair of Z-shaped contact holding members upside down attached to opposite two of said side walls, each of said contacts holding members including a plurality of contacts each including an upper horizontal section far engagement with a printed circuit board which has an opening receiving said shell therein, and a lower upwardly obliquely contact section for engagement with an electronic component received in said receiving space; and a pair of metallic shielding pieces cooperating with said opposite two of the side walls to sandwich the corresponding contact holding members, respectively; wherein the other two opposite of said side walls form resilient contact tongues for retaining the electronic component in the receiving space; wherein an upper face of the shielding piece is essentially coplanar with a downward engagement face of the resilient contact tongue which is adapted to engage the printed circuit board.

* * * * *